US009863130B1

(12) United States Patent
Abram et al.

(10) Patent No.: US 9,863,130 B1
(45) Date of Patent: Jan. 9, 2018

(54) PRESSURE FLUSHING FUNNEL FOR A TOILET

(71) Applicants: Tony Abram, Anaheim, CA (US); Linda Abram, Anaheim, CA (US)

(72) Inventors: Tony Abram, Anaheim, CA (US); Linda Abram, Anaheim, CA (US)

( * ) Notice: Subject to any disclaimer, the term of this patent is extended or adjusted under 35 U.S.C. 154(b) by 0 days.

(21) Appl. No.: 15/139,323

(22) Filed: Apr. 26, 2016

Related U.S. Application Data

(60) Provisional application No. 62/153,457, filed on Apr. 27, 2015.

(51) Int. Cl.
*E03D 9/00* (2006.01)
*E03C 1/304* (2006.01)
*B67C 11/00* (2006.01)

(52) U.S. Cl.
CPC ..... *E03C 1/304* (2013.01); *B67C 11/00* (2013.01); *E03D 9/00* (2013.01)

(58) Field of Classification Search
CPC ... E03C 1/30; E03C 1/304; E03D 9/00; B67C 1/00
USPC ..... 4/255.01, 255.04
See application file for complete search history.

(56) References Cited

U.S. PATENT DOCUMENTS 4,137,577 A * 2/1979 Maxfield ..... E03D 9/00 4/222
4,282,611 A * 8/1981 O'Day ..... E03D 11/025 4/144.1
4,768,237 A 9/1988 Torti
5,403,166 A 4/1995 Pingiotti
6,154,891 A * 12/2000 Wilson ..... A47K 11/12 141/331
6,205,594 B1 3/2001 Solaberry
9,637,906 B1 * 5/2017 Charles ..... E03D 13/00
2011/0214782 A1 * 9/2011 McGeary ..... B67C 11/00 141/337
2015/0225934 A1 * 8/2015 Weyers ..... E03C 1/30 4/255.01

* cited by examiner

*Primary Examiner* — Huyen Le
(74) *Attorney, Agent, or Firm* — RG Patent Consulting, LLC; Rachel Gilboy

(57) ABSTRACT

A pressure flushing funnel for a toilet is a funnel that is curved to make a 90 degree bend, one end of which can be inserted into the opening of the flush channel of a toilet bowl. The funnel is held in place via a holding bracket that overlaps the sides of the bowl and prevents lateral movement. A predetermined amount of water is rapidly poured into the top end of the funnel which increases pressure as it nears the opening of the flush channel to dislodge the obstruction.

18 Claims, 4 Drawing Sheets

PRESSURE FLUSHING FUNNEL FOR A TOILET

CROSS-REFERENCE TO RELATED APPLICATION

The present application is related to and claims priority from prior provisional application Ser. No. 62/153,457, filed Apr. 27, 2015 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of toilet obstruction clearing devices and more specifically relates to a pressure flushing funnel for a toilet.

2. Description of the Related Art

One of the conveniences of modern times is the advent of indoor water closets, or toilets. Moving them indoors has eliminated unmeasured burdens and inconveniences. For this to be accomplished, the septic tank and the toilet had to be separated by a distance through the use of running water within the home. Modern homes are plumbed with the convenience of running water for bathing, washing dishes, and for use in flushing away human waste into an infrastructure of wastewater collection pipelines that flow to a treatment plant. This type of system has been in use long enough that the inconvenience of the prior system has been for the most part, forgotten, until a problem arises. When a problem arises, it is most likely going to be an obstruction within the pipeline between the toilet and the collection system main line in the street. The vast majority of these are obstructions are in the flush channel within the toilet gooseneck.

The gooseneck by design creates a separation between the wastewater collection system piping and the inside of the home by trapping a volume of water within the neck trap, which prevents sewer gases from freely entering the home. While the gooseneck is necessary for sanitation and safety, it also creates a problematic area for things to go wrong because the gooseneck is also a bottle neck in the flow channel between the home and the street piping. A small obstruction in the gooseneck may not easily be dislodged by merely flushing the toilet because the height of the column of water in the tank doesn't have enough force to remove very much. Additional help is often needed, but most of the devices used for this purpose are laborious to use and often cause splash back. An improvement is needed.

Various attempts have been made to solve the above-mentioned problems such as those found in U.S. Pat. No. 6,205,594 to Michael D. Solaberry; U.S. Pat. No. 5,403,166 to Ercolano Pingiotti; and U.S. Pat. No. 4,768,237 to Emanuel Torti. This art is representative of toilet plunger devices having an opening for pouring water to aid in unclogging a stopped-up toilet. None of the above inventions and patents, taken either singly or in combination, is seen to describe the invention as claimed.

Ideally, a toilet obstruction clearing device should provide ease of use and eliminate backsplash, and yet, would operate reliably and be manufactured at a modest expense. Thus, a need exists for a reliable pressure flushing funnel for a toilet to avoid the above-mentioned problems.

BRIEF SUMMARY OF THE INVENTION

In view of the foregoing disadvantages inherent in the known toilet obstruction clearing device art, the present invention provides a novel pressure flushing funnel for a toilet. (also referred to herein as Angle Flush). The general purpose of the present invention, which will be described subsequently in greater detail, is to provide ease of use and eliminate backsplash.

The pressure flushing funnel for a toilet preferably comprises an angle funnel having a first opening, a second opening, a funnel body portion having an inner volume, and a funnel holder having a circular portion with at least two L-brackets. The first opening and the second opening of the angle funnel are located at opposite ends of the funnel body portion. The L-brackets are attached to opposite sides of the circular portion with the 90 degree bends at the ends pointing downward and is designed for gripping the sides of the toilet to prevent the angle funnel from sliding laterally. The L-brackets are adjustable for different heights and widths of toilets. The second opening of the angle funnel slides through the circular portion of the funnel holder until an outer periphery cross-section of the angle funnel fully contacts the inner periphery of the circular portion. The funnel holder is designed to be placed upon the horizontal flat surface of the seat area of a toilet, with the lid in the up position.

The funnel body portion or the angle flush, bends approximately 90 degrees in relation to the ends of the centerline. The first opening of the funnel body portion is circular and is positioned horizontally and the second opening of the funnel body portion is also circular and is positioned vertically. The first opening of the funnel body portion is larger in diameter than the second opening. The first opening of the funnel body portion is designed to be positioned above the seat of a toilet when in an in-use condition.

The pressure flushing funnel for a toilet further includes a liquid container for use with the funnel body portion, which is designed for holding an optimum amount of water and for pouring it quickly into the first opening of the funnel body portion. Different containers may be used for the same purpose but with too small a volume of water no results are likely to be seen. With too large a volume of water, the funnel may possibly overflow if the volume of water entering the funnel does not enter the toilet flush channel at least as fast as it is poured into the funnel. The liquid container holds an optimum amount of water to force flush the toilet without overflowing the funnel or the toilet with the additional water of the tank being flushed simultaneously.

The funnel body portion is designed to be able to cause a higher column of water to exert a pressure force against an obstruction in a neck of a toilet flush channel than a toilet tank is able to by itself. The gradually narrowing inner volume of the funnel body portion and the fall rate and distance traveled causes the volume of water to increase force and pressure at the opening of the toilet flushing channel. The pressure flushing funnel for a toilet is also able to force a combination of a liquid and a granular composition such as cat litter through the angle funnel, similar to a slurry, with a very low likelihood of becoming obstructed when flushed in conjunction with the toilet tank.

The Angle Flush will be a wide-mouthed, curved plastic funnel designed to rest securely atop the rim of the toilet bowl, its down-tapering funnel end extending down into the opening at the bottom of the bowl, and—when a volume of water is poured into the top of the funnel—directing a forceful stream of water into the toilet drain and trap, flushing it clear. The Angle Flush would measure approximately 22 inches in total length, with a top diameter of approximately 5½ inches, and a bottom diameter—at the terminal end of the funnel—of 1½ to 2 inches. The sides of the Angle Flush will be molded with two down-curved, laterally-extending brackets which permit the Angle Flush to rest securely on the rim of the toilet bowl and keep it from moving around or tipping side to side. The Angle Flush retail package will also include a plastic pouring cup, this cup measuring 7½ inches in length/depth by 4½ inches in (top) diameter. With the Angle Flush positioned, the user will fill the included pouring cup with water, then pour the water all at once into the top end of the funnel while simultaneously flushing the toilet. This water will move rapidly, and at an angle, into the opening at the bottom of the toilet bowl, forcing the clogged material into the toilet trap and drain, and flushing the toilet. The Angle Flush will utilize the fluid dynamics of concentrated water-pressure to clear a stopped toilet—quickly, easily, cleanly, and with no labor required aside from flushing the toilet when pouring the water down the Angle Flush unit. For consumers who have used conventional plungers with often dismaying and even messy results, the Angle Flush would present a far superior alternative: easier to use and store, cleaner and more effective, without any backsplash. Clever in conception, thoughtful in design, conceived to meet a real need shared by virtually all households, and eminently affordable on virtually any household budget, the Angle Flush should clearly find a wide and enthusiastic reception in the consumer household, commercial, and institutional markets of America and the world.

The pressure flushing funnel for a toilet further may comprise a kit including at least one angle funnel, at least one funnel holder, at least one liquid container for use with the angle funnel, and at least one set of user instructions.

A method of using a pressure flushing funnel for a toilet may comprise the steps of, placing the funnel holder on the flat surface of a toilet seat, inserting the second opening of the angle funnel through the circular portion of the funnel holder until the outer periphery of the angle funnel fully contacts the inner periphery of the circular portion, filling a liquid container with water, rapidly pouring the water out of the liquid container and into the first end of the angle funnel while flushing the toilet to remove an obstruction within a toilet flush channel of the toilet, removing the funnel holder and the angle funnel from the toilet, cleaning the funnel holder and the angle funnel, and storing the funnel holder and the angle funnel. The present invention holds significant improvements and serves as a pressure flushing funnel for a toilet. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, pressure flushing funnel for a toilet, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a toilet obstruction clearing device and more particularly to a pressure flushing funnel for a toilet also referred to herein as Angle Flush as used to improve the ease of use and eliminate backsplash.

Generally speaking, the pressure flushing funnel for a toilet is a funnel that is curved to make a 90 degree bend, one end of which can be inserted into the opening of the flush channel of a toilet bowl. The funnel is held in place via a holding bracket that overlaps the sides of the bowl and prevents lateral movement. A predetermined amount of water is rapidly poured into the top end of the funnel which increases pressure as it nears the opening of the flush channel to dislodge the obstruction.

The Angle Flush will be a wide-mouthed, curved plastic funnel designed to rest securely atop the rim of the toilet bowl, its down-tapering funnel end extending down into the opening at the bottom of the bowl, and—when a volume of water is poured into the top of the funnel—directing a forceful stream of water into the toilet drain and trap, flushing it clear. The Angle Flush would measure approximately 22 inches in total length, with a top diameter of approximately 5½ inches, and a bottom diameter—at the terminal end of the funnel—of 1½ to 2 inches.

The sides of the Angle Flush will be molded with two down-curved, laterally-extending brackets which permit the Angle Flush to rest securely on the rim of the toilet bowl and keep it from moving around or tipping side to side. The Angle Flush retail package will also include a plastic pouring cup, this cup measuring 7½ inches in length/depth by 4½ inches in (top) diameter.

With the Angle Flush positioned, the user will fill the included pouring cup with water, then pour the water all at once into the top end of the funnel while simultaneously flushing the toilet. This water will move rapidly, and at an angle, into the opening at the bottom of the toilet bowl, forcing the clogged material into the toilet trap and drain, and flushing the toilet.

The Angle Flush will utilize the fluid dynamics of concentrated water-pressure to clear a stopped toilet—quickly, easily, cleanly, and with no labor required aside from flushing the toilet when pouring the water down the Angle Flush unit. For consumers who have used conventional plungers with often dismaying and even messy results, the Angle Flush would present a far superior alternative: easier to use and store, cleaner and more effective, without any backsplash.

Clever in conception, thoughtful in design, conceived to meet a real need shared by virtually all households, and eminently affordable on virtually any household budget, the Angle Flush should clearly find a wide and enthusiastic reception in the consumer household, commercial, and institutional markets of America and the world.

Figure 1:
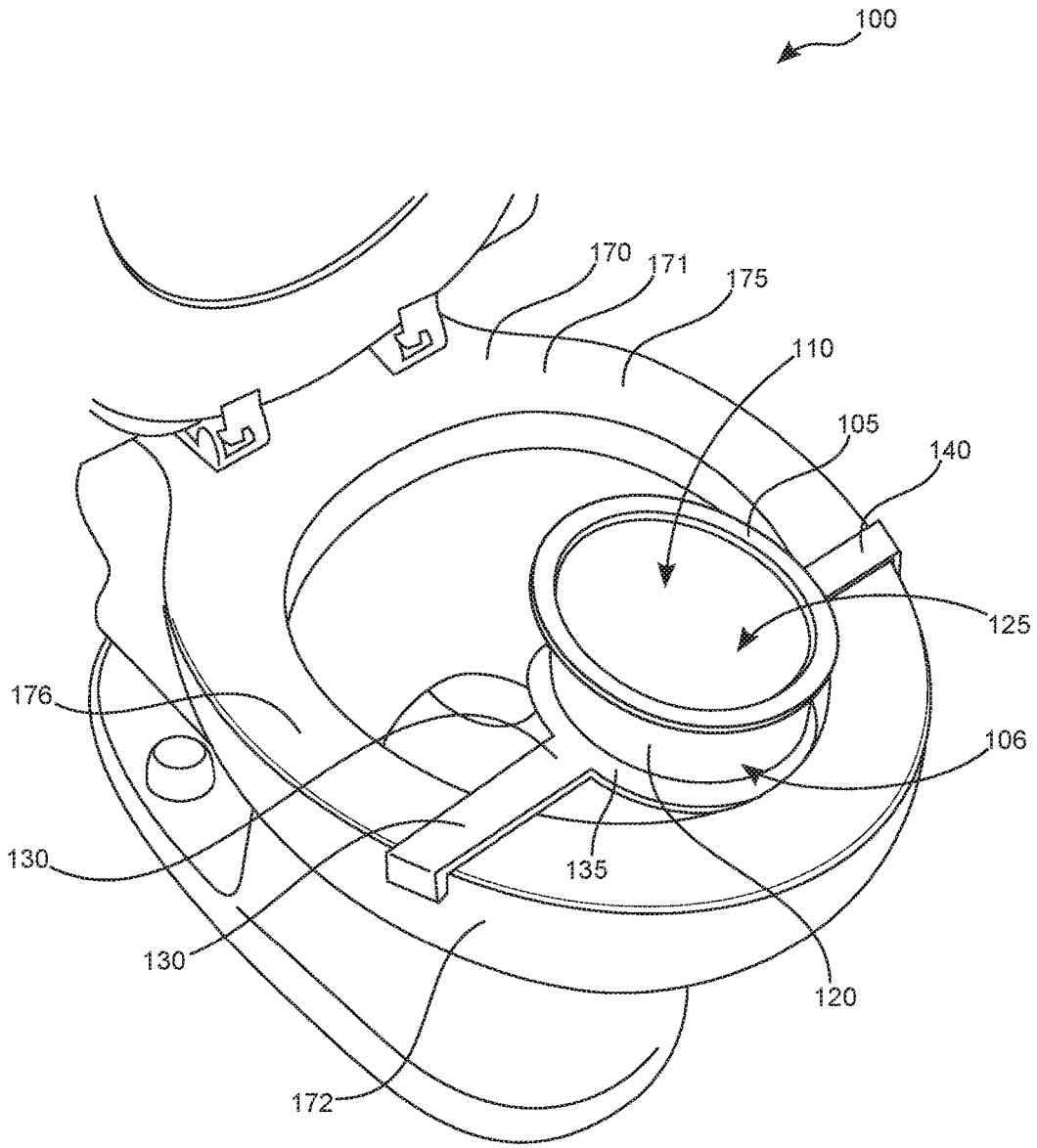
FIG. 1 shows a perspective view illustrating an in-use condition of a pressure flushing funnel for a toilet according to an embodiment of the present invention.

Referring to the drawings by numerals of reference there is shown in FIG. 1, a perspective view illustrating an in-use condition of pressure flushing funnel for a toilet 100 according to an embodiment of the present invention.

With angle funnel 105 in the in-use position in toilet bowl 171, funnel body portion 120 is held upright via funnel holder 130. L-bracket(s) 140 are attached to opposite sides of circular portion 135 with 90 degree bends 145 at ends 146 pointing downward and is designed for gripping the sides of toilet 170 to prevent angle funnel 105 from sliding laterally. Second opening 115 of angle funnel 105 slides through circular portion 135 of funnel holder 130 until outer periphery cross-section 106 of angle funnel 105 fully contacts inner periphery 136 of circular portion 135. Funnel holder 130 is designed to be placed upon horizontal flat surface 176 of seat 175 area of toilet 170, with the lid in the up position.

Funnel body portion 120 is designed to be able to cause a higher column of water to exert a pressure force against an obstruction in a neck of toilet flush channel 185 than toilet tank 190 is able to. The gradually narrowing inner volume 125 of funnel body portion 120 and the fall rate and distance traveled causes the volume of water to increase force and pressure at the opening of toilet flush channel 185. Pressure flushing funnel for a toilet 100 is also able to force a combination of a liquid and a granular composition through angle funnel 105, similar to a slurry, with a low likelihood of becoming obstructed. A practical application of this is the controlled flushing of animal waste with the granular litter.

Figure 2:
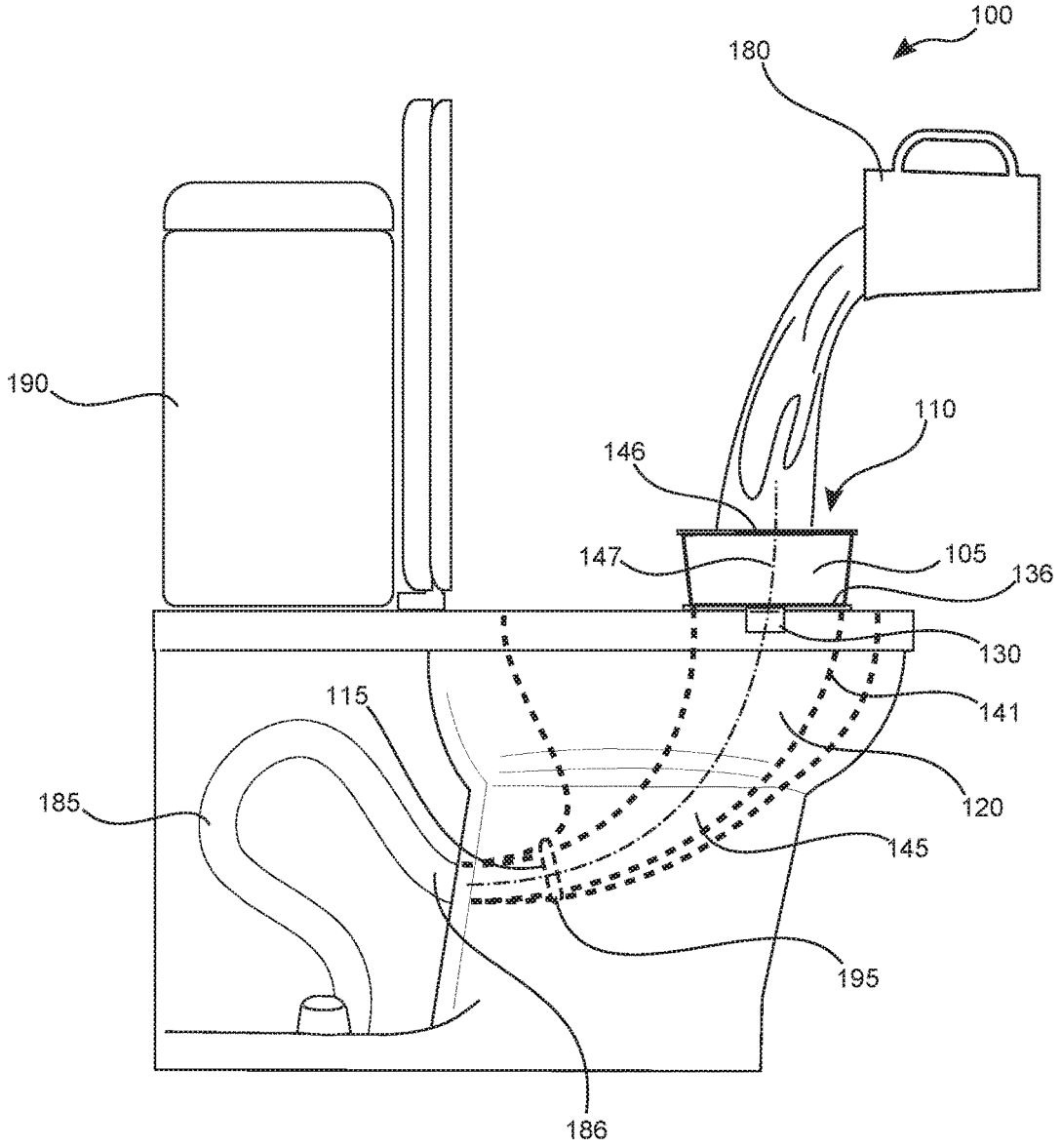
FIG. 2 is a side view illustrating an installed pressure flushing funnel for a toilet according to an embodiment of the present invention of FIG. 1.

Referring now to FIG. 2, is a side view illustrating an installed pressure flushing funnel for a toilet according to an embodiment of the present invention of FIG. 1.

Pressure flushing funnel for a toilet 100 preferably comprises angle funnel 105 having first opening 110, second opening 115, funnel body portion 120 having inner volume 125, and funnel holder 130 having circular portion 135 with at least two L-bracket(s) 140. First opening 110 and second opening 115 of angle funnel 105 are located at opposite ends of funnel body portion 120.

Funnel body portion 120 bends approximately 90 degrees in relation to ends 146 of centerline 147. First opening 110 of funnel body portion 120 is circular and is positioned horizontally and second opening 115 of funnel body portion 120 is also circular and is positioned vertically. First opening 110 of funnel body portion 120 is larger in diameter than second opening 115. First opening 110 of funnel body portion 120 is designed to be positioned above seat 175 of toilet 170 when in an in-use condition. In some embodiments, second opening 115 may have a rubber grommet around second opening 115 to facilitate the sealing of angle funnel 105 with neck 186 toilet flush channel 185.

Figure 3:
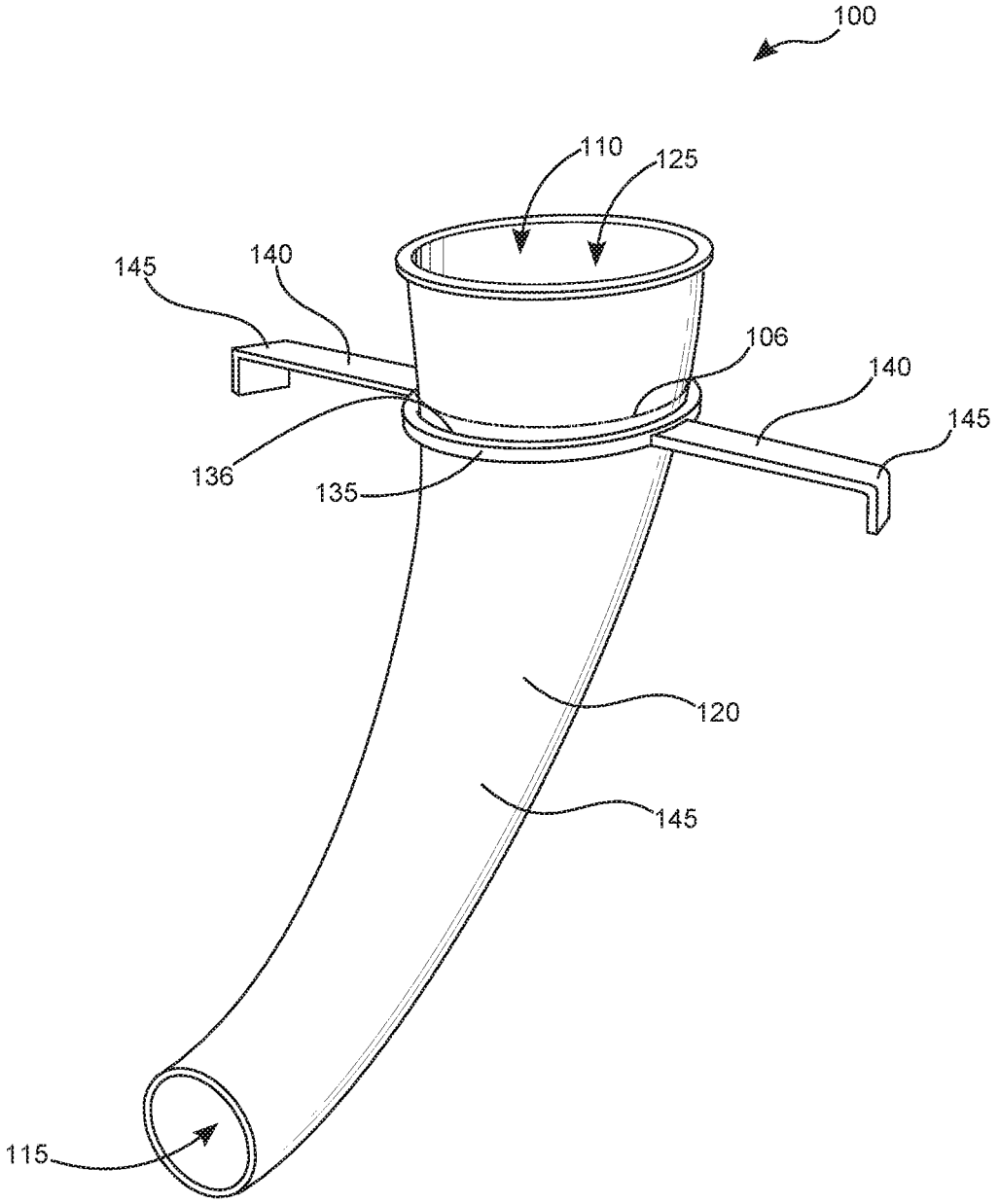
FIG. 3 is a perspective view illustrating the pressure flushing funnel for a toilet according to an embodiment of the present invention of FIG. 1.

Referring now to FIG. 3, is a perspective view illustrating pressure flushing funnel for a toilet 100 according to an embodiment of the present invention of FIG. 1.

Pressure flushing funnel for a toilet 100 further includes liquid container 180 for use with funnel body portion 120, which is designed for holding an optimum amount of water and for pouring it quickly into first opening 110 of funnel body portion 120. Different containers may be used for the same purpose but with too small a volume of water no results are likely to be seen. With too large a volume of water, angle funnel 105 may possibly overflow if the volume of water entering angle funnel 105 does not enter toilet flush channel 185 at least as fast as it is poured into angle funnel 105. Liquid container 180 holds an optimum amount of water to force flush toilet 170 without overflowing angle funnel 105.

Figure 4:
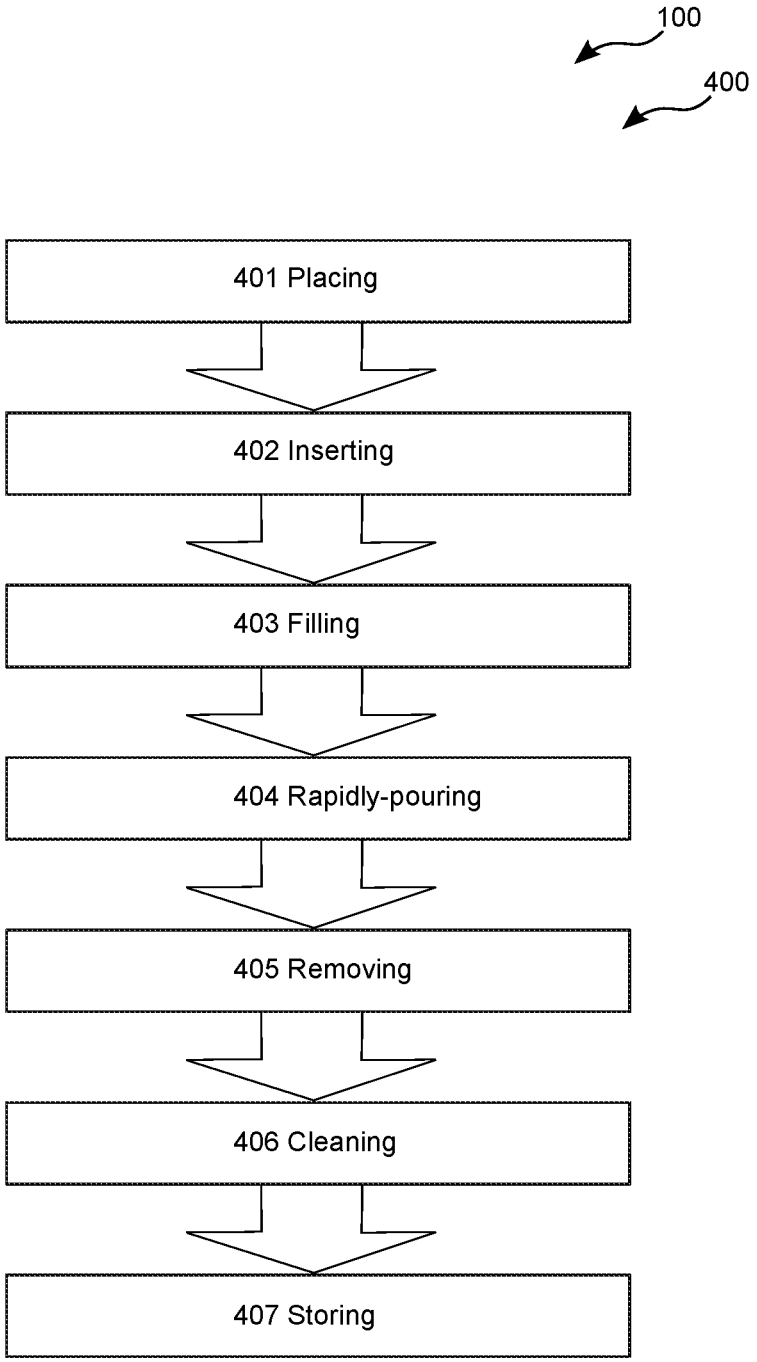
FIG. 4 is a flowchart illustrating a method of use for pressure flushing funnel for a toilet according to an embodiment of the present invention of FIGS. 1-4.

Referring now to FIG. 4, showing method of use 400 for pressure flushing funnel for a toilet 100. A method of using pressure flushing funnel for a toilet 100 may comprise the steps of step one 401 placing funnel holder 130 on horizontal flat surface of toilet 170; step two 402 inserting second opening 115 of angle funnel 105 through circular portion 135 of funnel holder 130 until outer periphery cross-section 106 of angle funnel 105 fully contacts inner periphery 136 of circular portion 135; step three 403 filling liquid container 180 with water; step four 404 rapidly pouring the water out of liquid container 180 and into first opening 110 of angle funnel 105 while flushing to remove an obstruction within toilet flush channel 185 of toilet 170; step five 405 removing funnel holder 130 and angle funnel 105 from toilet 170; step six 406 cleaning funnel holder 130 and angle funnel 105; step seven 407 storing funnel holder 130 and angle funnel 105.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

Pressure flushing funnel for a toilet 100 may be sold as kit 450 comprising the following parts: at least one angle funnel 105; at least one funnel holder 130; at least one liquid container 180 for use with angle funnel 105; and at least one set of user instructions. The kit has instructions such that functional relationships are detailed in relation to the structure of the invention (such that the invention can be used, maintained, or the like in a preferred manner). Pressure flushing funnel for a toilet 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A pressure flushing funnel for a toilet comprising:

an angle funnel having a first opening, a second opening, and a funnel body portion having an inner volume, wherein said first opening and said second opening are located at opposite ends of said funnel body portion;

a funnel holder having a circular portion and at least two 1-brackets, wherein said at least two 1-brackets are attached to opposite sides of said circular portion and is designed for said second opening of said angle funnel to slide therethrough until an inner periphery of said circular portion fully contacts an outer periphery cross-section of said angle funnel; and wherein said pressure flushing funnel for a toilet is useful for forcefully flushing a toilet to eliminate an obstruction therein.

2. The pressure flushing funnel for a toilet of claim 1 wherein said funnel body portion bends approximately 90 degrees.

3. The pressure flushing funnel for a toilet of claim 1 wherein said first opening of said funnel body portion is circular and is positioned horizontally.

4. The pressure flushing funnel for a toilet of claim 1 wherein said second opening of said funnel body portion is circular and is positioned vertically.

5. The pressure flushing funnel for a toilet of claim 1 wherein said first opening of said funnel body portion is larger in diameter than said second opening.

6. The pressure flushing funnel for a toilet of claim 1 wherein said first opening of said funnel body portion is designed to be positioned above a seat of a toilet when in an in-use condition.

7. The pressure flushing funnel for a toilet of claim 1 wherein said pressure flushing funnel for a toilet further includes a liquid container for use therewith.

8. The pressure flushing funnel for a toilet of claim 1 wherein said liquid container further is designed to contain a measured amount of water for pouring rapidly into said first opening of said funnel body portion.

9. The pressure flushing funnel for a toilet of claim 1 wherein said funnel body portion is designed to be able to cause a higher column of water to exert a pressure force against an obstruction in a neck of a toilet flush channel than a toilet tank is able to.

10. The pressure flushing funnel for a toilet of claim 1 wherein said funnel body portion is designed to be able to cause a higher velocity of water to be forced into said toilet flush channel than said toilet tank is able to.

11. The pressure flushing funnel for a toilet of claim 1 wherein said funnel holder is designed to be placed upon a horizontal flat surface of a seat area of said toilet.

12. The pressure flushing funnel for a toilet of claim 1 wherein said at least two 1-brackets of said funnel holder each further comprise a 90 degree bend at an outside perimeter.

13. The pressure flushing funnel for a toilet of claim 1 wherein said 90 degree bend of said at least two 1-brackets are adapted to downwardly overlap said horizontal flat surface of said seat area to prevent a lateral movement of said funnel body portion when in an in-use condition.

14. The pressure flushing funnel for a toilet of claim 1 wherein said second opening of said funnel body portion further comprises a flexible rubber portion for sealing against said opening of said toilet flush channel.

15. The pressure flushing funnel for a toilet of claim 1 wherein said pressure flushing funnel for a toilet is able to force a combination of a liquid and a granular composition through said angle funnel.

16. A pressure flushing funnel for a toilet comprising:

an angle funnel having a first opening, a second opening, and a funnel body portion having an inner volume, wherein said first opening and said second opening are located at opposite ends of said funnel body portion;

a funnel holder having a circular portion and at least two 1-brackets, wherein said at least two 1-brackets are attached to opposite sides of said circular portion and is designed for said second opening of said angle funnel to slide therethrough until an inner periphery of said circular portion fully contacts an outer periphery cross-section of said angle funnel;

wherein said funnel holder is designed to be placed upon a horizontal flat surface of a seat area of said toilet;

wherein said at least two 1-brackets of said funnel holder each further comprise a 90 degree bend at an outside perimeter;

wherein said 90 degree bend of said at least two 1-brackets are adapted to downwardly overlap said horizontal flat surface of said seat area to prevent a movement of said funnel body portion when in an in-use condition;

wherein said funnel body portion bends approximately 90 degrees;

wherein said first opening of said funnel body portion is circular and is positioned horizontally;

wherein said second opening of said funnel body portion is circular and is positioned vertically;

wherein said first opening of said funnel body portion is larger in diameter than said second opening;

wherein said first opening of said funnel body portion is designed to be positioned above a seat of a toilet when in an in-use condition;

wherein said pressure flushing funnel for a toilet further includes a liquid container for use therewith;

wherein said liquid container further is designed to contain a measured amount of water for pouring rapidly into said first opening of said funnel body portion while flushing said toilet;

wherein said funnel body portion is designed to be able to cause a higher column of water to exert a pressure force against an obstruction in a neck of a toilet flush channel than a toilet tank is able to;

wherein said funnel body portion is designed to be able to cause a higher velocity of water to be forced into said toilet flush channel than said toilet tank is able to;

wherein said pressure flushing funnel for a toilet is able to force a combination of a liquid and a granular composition through said angle funnel; and wherein said pressure flushing funnel for a toilet is useful for forcefully flushing a toilet to eliminate an obstruction therein.

17. The pressure flushing funnel for a toilet of claim 16 further comprising a kit including:

at least one angle funnel;

at least one funnel holder;

at least one liquid container for use with said angle funnel; and at least one set of user instructions.

18. A method of using a pressure flushing funnel for a toilet comprising the steps of:

placing a funnel holder on a flat surface of a seat area of a toilet;

inserting a second opening of an angle funnel of a pressure flushing funnel for a toilet through a circular portion of a funnel holder until an outer periphery of said angle funnel fully contacts an inner periphery of said circular portion;

filling a liquid container with water;

rapidly pouring said water out of said liquid container and into said first end of said angle funnel while flushing said toilet to remove an obstruction within a toilet flush channel of a toilet;

removing said funnel holder and said angle funnel from said toilet;

cleaning said funnel holder and said angle funnel; and storing said funnel holder and said angle funnel.

* * * * *